US006426037B1

(12) United States Patent
Fieber

(10) Patent No.: US 6,426,037 B1
(45) Date of Patent: Jul. 30, 2002

(54) DOSING CHAMBER METHOD AND APPARATUS

(76) Inventor: John B. Fieber, 3200 Northwoods Rd., Port Washington, WI (US) 53074

( * ) Notice: Subject to any disclaimer, the term of this patent is extended or adjusted under 35 U.S.C. 154(b) by 0 days.

(21) Appl. No.: 09/564,832

(22) Filed: May 4, 2000

Related U.S. Application Data

(60) Provisional application No. 60/132,739, filed on May 6, 1999.

(51) Int. Cl.[7] ..... C21C 5/42
(52) U.S. Cl. ..... 266/239; 266/242; 266/286
(58) Field of Search ..... 266/239, DIG. 1, 266/280, 281, 286, 242

(56) References Cited

U.S. PATENT DOCUMENTS

| | | | | |
|---|---|---|---|---|
| 3,735,010 A | * | 5/1973 | Turpin | 266/DIG. 1 |
| 3,984,613 A | | 10/1976 | Reese | |
| 4,138,096 A | * | 2/1979 | Boucher et al. | 266/242 |
| 4,220,319 A | * | 9/1980 | Rohmann | 266/239 |
| 4,372,544 A | * | 2/1983 | LaBate | 266/DIG. 1 |
| 4,526,351 A | * | 7/1985 | LaBate | 266/DIG. 1 |
| 4,741,514 A | | 5/1988 | Bleickert | |
| 4,783,061 A | * | 11/1988 | LaBate et al. | 266/281 |
| 5,477,907 A | * | 12/1995 | Meyer et al. | 266/239 |
| 5,700,422 A | * | 12/1997 | Usui et al. | 266/239 |

FOREIGN PATENT DOCUMENTS

DE 004403285 A1 * 8/1995

* cited by examiner

*Primary Examiner*—Scott Kastler
(74) *Attorney, Agent, or Firm*—Joseph S. Heino

(57) ABSTRACT

A dosing chamber is insertable within and removable from the metal holding chamber of a molten metal furnace and is not formed as an integral part of the refractory lining of the molten metal furnace. The dosing chamber includes a chamber shell having a gas inlet port and a molten metal discharge port. The gas inlet port is functionally adapted to sealingly receive a gas stopper tube within the port. With a pressurized inert gas introduced through the gas stopper tube, molten metal contained within the dosing chamber is force out of the discharge port and up and into a metal receiver. The dosing chamber method and apparatus of the present invention is functionally adapted to be insertable within a variety of commercially available furnaces. The dosing chamber method and apparatus of the present invention may also be functionally adapted to be readily removable from the molten metal chamber such that the dosing chamber can be removed and cleaned as such is desired or required.

15 Claims, 2 Drawing Sheets

FIG. 1
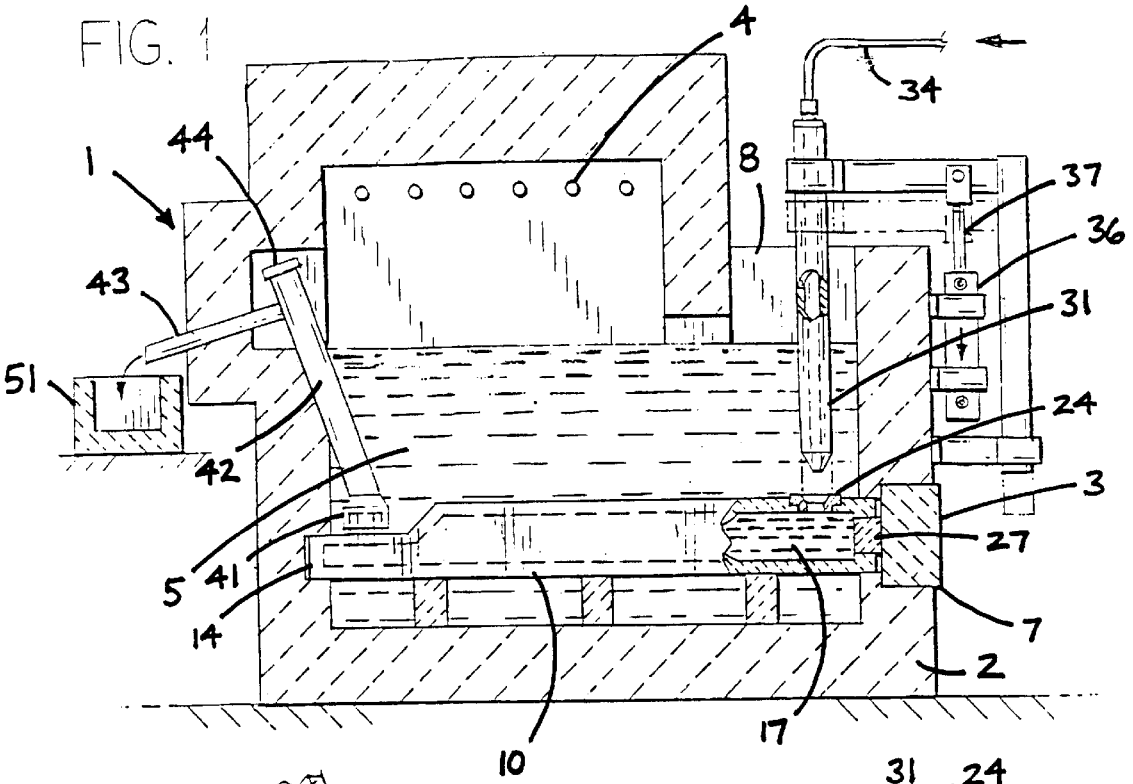
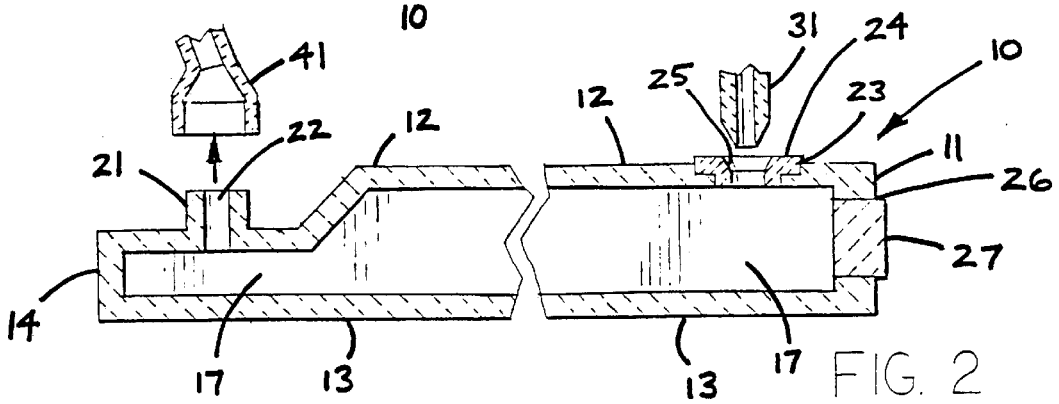
FIG. 2
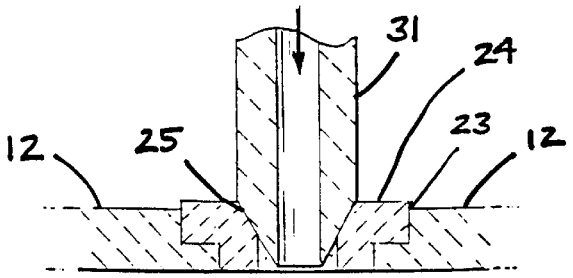
FIG. 3

DOSING CHAMBER METHOD AND APPARATUS

This Application claims the benefit of U.S. Provisional Application No. 60/132,739, filed May 6, 1999.

FIELD OF THE INVENTION

This invention relates generally to methods and apparatus for holding and delivering molten nonferrous metal to a shot sleeve and/or a pour cup of a casting machine. More specifically, it relates to a method and apparatus for holding within a dosing furnace a predetermined volume of molten nonferrous metal by means of a specialized holding chamber, which holding chamber facilitates the pressurized delivery of molten metal for filling a shot sleeve, pour cup, mold, casting or the like. It also relates to a holding chamber which may be functionally adapted to be readily removable from the dosing furnace to facilitate cleaning of the holding chamber.

BACKGROUND OF THE INVENTION

In the area of furnaces used for melting and holding nonferrous metals, it has long been recognized as advantageous to provide integral apportioning devices within such furnaces for the removal of predetermined volumes of molten metal from the furnaces. In this fashion, the volume of molten metal which is removed can be controlled. Uniformity in pours can also be achieved. Typically, such an apportioning device uses a compressed gas to force a predetermined amount of molten metal from a reservoir to a delivery means. The gas most often used for this purpose is nitrogen. Nitrogen is inert with respect to nonferrous molten metals such as aluminum.

In the experience of this inventor, one problem encountered by the use of such dosing chambers is the fact that they are difficult to clean, repair and/or replace if such is desired or required. The cleaning of such a dosing chamber requires the complete emptying of the contents of the furnace and a relatively long cooling off period for the furnace. This creates down time for the furnace which is not practical or efficient in a high volume production setting.

SUMMARY OF THE INVENTION

It is, therefore, a principal object of this invention to provide a new, useful and uncomplicated method and apparatus for accurately delivering predetermined amounts of molten metal as such metal is desired or required. It is a further object of this invention to provide such a method and apparatus which requires only a minimal number of elements and which requires only a minimal number of steps to utilize. It is yet another object of this invention to provide such a method and apparatus which can readily used in a variety of furnace configurations. It is still another object of this invention to provide such a method and apparatus which provides for a readily removable dosing chamber which is adaptable to be usable within a variety of new and existing furnaces which are commercially available. It is still another object of this invention to provide a dosing chamber in accordance with the method and apparatus of the present invention which is not formed as an integral part of the refractory lining of a furnace. It is still another object of this invention to provide such a method and apparatus which may provide for a removable dosing chamber which can be used and reused over and over again.

The present invention has obtained these objects. It provides for a dosing chamber which may be insertable within and removable from the metal holding chamber of a molten metal furnace. The dosing chamber of the present invention is not formed as an integral part of the refractory lining of the molten metal furnace. The dosing chamber of the present invention also includes a chamber shell having a gas inlet port and a molten metal discharge port. The gas inlet port is functionally adapted to sealingly receive a gas stopper tube within the port. With a pressurized inert gas introduced through the gas stopper tube, molten metal contained within the dosing chamber is force out of the discharge port and up and into a metal receiver. The dosing chamber method and apparatus of the present invention is functionally adapted to be insertable within a variety of commercially available furnaces. The dosing chamber method and apparatus of the present invention may also be functionally adapted to be readily removable from the molten metal chamber such that the dosing chamber can be removed and cleaned as such is desired or required. The foregoing and other features of the method and apparatus of the present invention will be further apparent from the description which follows.

BRIEF DESCRIPTION OF THE DRAWINGS

FIG. 1 is a vertical section through a dosing chamber apparatus constructed in accordance with the present invention.

FIG. 2 is an enlarged vertical section through the dosing chamber shown in FIG. 1 and further showing, in particular, the stopper tube and seat of a gas delivery assembly.

FIG. 3 is a further enlarged vertical section through the stopper tube and seat of the dosing chamber shown in FIGS. 1 and 2.

DETAILED DESCRIPTION

Figure 4:
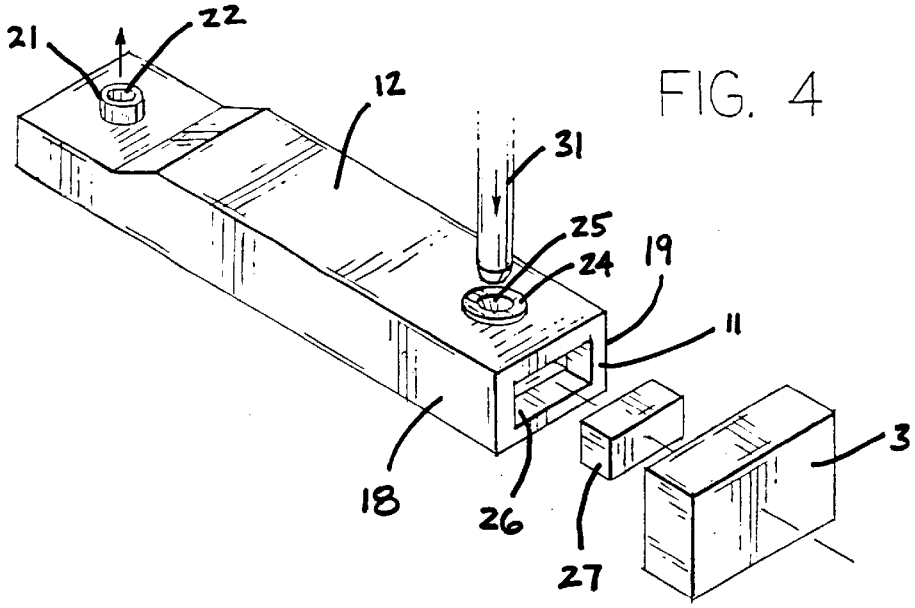
FIG. 4 is a perspective view of the dosing chamber shown in FIG. 2 and further showing, in particular, the details of an access port of the chamber.

Referring now to the drawings in detail, FIG. 2 shows a preferred embodiment of a molten metal dosing chamber, generally identified 10, which is constructed in accordance with the method and apparatus of the present invention. As shown in FIG. 1, the dosing chamber 10 is insertable within the metal holding chamber 5 of a molten metal furnace, generally identified 1. The chamber 10 may be insertable through a shell opening 7 situated in one side of the holding furnace shell 2 or through the top opening 8 of the furnace 1. The shell opening 7 is sealable by means of a refractory plug 3. Though this opening 7 and plug 3 configuration could be constructed in a number of ways well known in the art, it is sufficient to an understanding of the present invention to say that the only requirement is that the refractory plug 3 provide a virtual continuum of the refractory lining of the holding furnace shell 2. The dosing chamber 10, which in FIG. 1 is shown in a horizontal orientation, includes a first end portion 11, a top portion 12, a bottom portion 13 and a second end portion 14. The first chamber shell end portion 11 is somewhat larger than its opposing counterpart, i.e. the second chamber shell end portion 14, for reasons which will become more apparent later in this detailed description. The first chamber shell end portion 11 is configured, in the preferred embodiment shown, with a clean out port 26 and plug 27. The end, top and bottom portions 11, 12, 13, 14 of the chamber 10, together with opposing side walls 18, 19, form a chamber cavity 17 which is functionally adapted to hold and retain molten metal within its walls. In the experience of this inventor, the chamber 10 can be constructed of a silicon carbide, silicon carbide nitrite bonded or fused silica material. This material is generally heat resistant to the high temperatures of the molten metal to which the chamber 10 is exposed. Near the first end 11 of the top chamber portion 12 of the chamber 10, a metal and gas inlet port 23 is provided. The inlet port 23 is, in the preferred embodiment, fitted with a seat 24. The seat 24, which may be removable, includes a chamfered inner surface 25 which is functionally adapted to receive the end of a stopper tube 31 within it. See FIG. 3. It is through this stopper tube 31 that an inert gas, such as nitrogen, is introduced to the interior cavity 17 of the shell 10. Near the second end 14 of the top surface 12 of the shell 10 is a metal outlet port 22. The metal outlet port 22 includes a sealing shoulder 21 which is functionally adapted to be engageable with the filling end 41 of a stalk tube 42 and metering orifice and flow sensor 44. See FIG. 1. Other portions of the holding furnace 1 which are relevant to the understanding of the method and apparatus of the present invention are the electric heating elements 4 which are located at the top portion of the shell 2. A secondary shell opening 8 is provided through which the stopper tube 31 may be introduced. The stopper tube 31 is vertically movable by virtue of the actuating assembly 36, 37 located externally of the shell 2.

Figure 5:
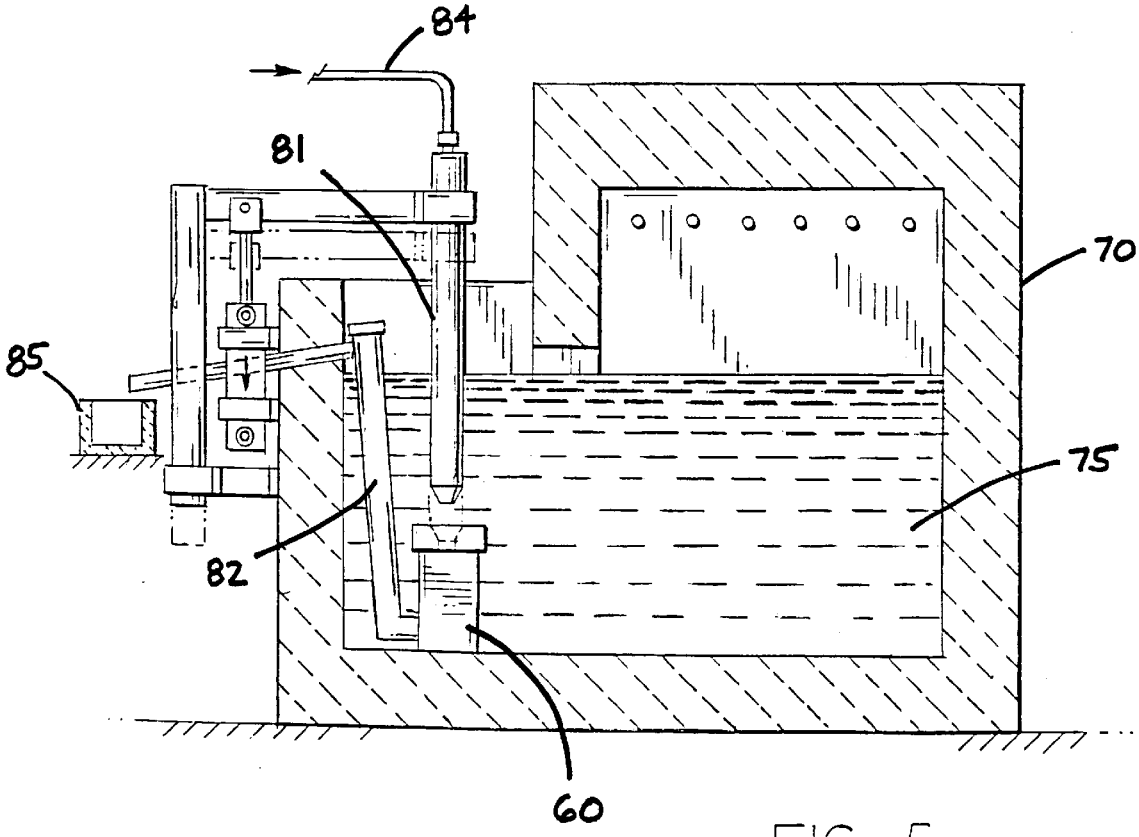
FIG. 5 is a vertical section through a dosing chamber apparatus constructed in accordance with the present invention, but showing the dosing chamber in a vertical orientation.

In an alternative embodiment of the method and apparatus of the present invention, another dosing chamber, generally identified 60, is shown in a vertical orientation. See FIG. 5. The advantage of the vertical orientation is that this configuration may facilitate use of the method and apparatus of the present invention in a furnace which either does not have sufficient space at the bottom of the metal holding chamber 75 to hold the dosing chamber 60 or which is required to be retrofitted with such a chamber 60.

In application, the horizontally oriented dosing chamber 10 as shown in FIG. 1 is slid through the shell opening 7 of the furnace shell 2. As shown, the dosing chamber 10 includes a chamber plug 27 which is placed within the chamber side opening 26. See FIG. 4. The alignment of the dosing chamber 10 is such that the stopper tube 31 can be lowered to engage the seat 24 situated at the top 12 of the dosing chamber 10. See FIGS. 1, 2 and 4. The refractory plug 3 is then placed within the holding furnace shell opening 7 to seal the shell 2 and provide a continuous insulating refractory lining for that portion of the furnace 1 which will eventually be filled with molten metal. As the heater elements 4 of the furnace heat up and molten metal is introduced into the metal holding chamber 5, molten metal pours into and fills the inner cavity 17 of the dosing chamber 10. The stopper tube 31 is then actuated to lower the bottom most tip of it into sealing engagement with the closure plate 24 of the dosing chamber 10. With the lower end 41 of the stalk tube 42 located over the metal outlet port 21, 22 of the dosing chamber 10, the dosing chamber 10 is ready to have a predetermined volume of gas introduced through the gas delivery line 34 and into the dosing chamber cavity 17. Since the gas will assume and fill the higher portions of the dosing chamber cavity 17, the molten metal contained within the cavity 17 will be forced out of the dosing chamber 10 via the outlet port 21, 22. The molten metal will then travel up the stalk tube 42 and out to the exterior of the furnace 1 to a pour cup and shot sleeve or other similar device 51.

Removal and cleaning of the dosing chamber 10 is accomplished by allowing the furnace to be emptied of its contents of molten metal. The dosing chamber 10 is then withdrawn and replaced through the side shell opening 7 or through the top opening 8 of the furnace 1. While the horizontally oriented dosing chamber 10 so described is shown to be rigidly retained within the metal holding chamber 5 of the furnace 1, it is to be understood that such is not necessary to accomplish the method and apparatus of the present invention. It is sufficient that the dosing chamber 10 be submergeable below the molten metal such that the chamber fills with molten metal and the inert gas activate the flow process as previously described. This feature is particularly important when considering the application of the vertically oriented dosing chamber 60 shown in FIG. 5. With the dosing chamber 60 located within that part of the metal holding chamber 75 of the furnace 70 immediately below the stopper tube 81, the gas is similarly introduced through the delivery line 84 and into the top portion of the dosing chamber cavity (not shown). This forces the molten metal contained within the dosing chamber 60 up and out of the stalk tube 82 and into a delivery ladle or other device 85.

From the foregoing detailed description of the illustrative embodiment of the invention set forth herein, it will be apparent that there has been provided a new, useful and uncomplicated method and apparatus for accurately delivering predetermined amounts of molten metal as such metal is desired or required; which requires only a minimal number of elements and which requires only a minimal number of steps to utilize; which can readily used in a variety of furnace configurations; which provides for a readily removable dosing chamber which is adaptable to be usable within a variety of existing furnaces which are commercially available; which provides a dosing chamber which is not formed as an integral part of the refractory lining of a furnace; and which may provide for a removable dosing chamber which can be used and reused over and over again.

The principles of this invention having been fully explained in connection with the foregoing, I hereby claim as my invention:

1. A molten metal dosing chamber that is insertable within the refractory shell of a molten metal furnace, said dosing chamber not being formed as a part of the refractory lining of said furnace shell, which comprises a chamber shell having a gas inlet port and a molten metal discharge port, a stopper tube that descends into said gas inlet port to charge the dosing chamber with a predetermined volume of gas and ascends to allow molten metal to charge the dosing chamber, a stalk tube connected to the discharge port, wherein a predetermined volume of pressurized gas from the stopper tube forces the molten metal inside the dosing chamber to the discharge port, up the stalk tube and into a dosing cup in exact amounts.

2. The dosing chamber of claim 1 wherein said chamber shell has the shape of a rectangular prism.

3. The dosing chamber of claim 2 wherein said chamber shell has a top surface, said top surface having a first portion and a second portion, wherein said first portion is situated in a plane located above said second portion, said gas inlet port being located within said first top surface portion and said molten metal discharge port being located within said second top surface portion.

4. The dosing chamber of claim 3 wherein said chamber shell is constructed of a silicon carbide, silicon carbide nitrite bonded or fused silica material.

5. A dosing chamber for use in a molten metal furnace and for use with a casting machine, said furnace having a furnace shell and a refractory lining for holding molten nonferrous metal therewith and said casting machine having a pour cup and/or a shot sleeve, said dosing chamber not being integrally formed with said furnace shell or with the refractory lining thereof, which comprises a dosing chamber shell, said dosing chamber shell being insertable within the metal holding shell of the furnace, a gas inlet port defined within said dosing chamber shell, said gas inlet port being functionally adapted to sealingly receive a gas stopper tube within the port, means for introducing a gas stopper tube to said gas inlet port, a molten metal discharge port defined within sad dosing chamber shell, means for introducing a stalk tube and metering orifice to said discharge port, and means for introducing a pressurized inert gas through said gas stopper tube whereby a predetermined volume of gas introduced through the gas stopper tube to the dosing chamber forces a volume of molten metal out of the discharge port and into the stalk tube to a pour cup and/or a shot sleeve of a casting machine.

6. The dosing chamber of claim 5 wherein said chamber shell has the shape of a rectangular prism.

7. The dosing chamber of claim 6 wherein said chamber shell has a top surface, said top surface having a first portion and a second portion, said first portion being situated generally above said second portion, and said gas inlet port being located within said first top surface portion and said molten metal discharge port being located within said second top surface portion.

8. The dosing chamber of claim 7 wherein said chamber shell is constructed of a silicon carbide, silicon carbide nitrite bonded or fused silica material.

9. A method for delivering molten nonferrous metal to a shot sleeve and/or a pour cup of a casting machine which comprises the steps of providing a molten metal furnace, said furnace having a refractory lining and shell for holding molten nonferrous metal therewithin, introducing a dosing chamber into said furnace metal holding refractory shell, said dosing chamber not being formed as a part of the refractory lining of said furnace shell, providing the dosing chamber with a gas inlet port, and providing the dosing chamber with a molten metal discharge port.

10. The method of claim 9 including the step of providing a gas stopper tube that descends into said inlet port to charge the dosing chamber with a predetermined volume of gas and ascends to allow molten metal to charge the dosing chamber.

11. The method of claim 10 including the step of introducing a stalk tube and metering orifice to said discharge port.

12. The method of claim 11 including the step of introducing a predetermined volume of pressurized inert gas through said gas stopper tube whereby molten metal contained within the dosing chamber is forced out of the discharge port.

13. The method of claim 12 wherein said dosing chamber introducing step includes the step of providing a dosing chamber shell having the shape of a rectangular prism.

14. The method of claim 13 wherein said dosing chamber introducing step includes the step of providing a dosing chamber having a top surface, said top surface having a first portion and a second portion, said first portion being situated above said second portion, and said gas inlet port being located within said first top surface portion and said molten metal discharge port being located within said second top surface portion.

15. The method of claim 14 wherein said dosing chamber shell providing step includes the step of providing a chamber shell which is constructed of a silicon carbide, silicon carbide nitrite bonded or fused silica material.

* * * * *